US006318921B1

(12) United States Patent
Craine

(10) Patent No.: US 6,318,921 B1
(45) Date of Patent: Nov. 20, 2001

(54) RETRACTABLE UNLOSEABLE MULTICOLORED PEN ASSEMBLY

(76) Inventor: Anne Craine, 8155 Pineverde, Jacksonville, FL (US) 32244

( * ) Notice: Subject to any disclaimer, the term of this patent is extended or adjusted under 35 U.S.C. 154(b) by 0 days.

(21) Appl. No.: 09/520,514

(22) Filed: Mar. 8, 2000

(51) Int. Cl.[7] ..... B43K 23/02
(52) U.S. Cl. ..... 401/131; 401/195; 401/52
(58) Field of Search ..... 401/131, 52, 195, 401/48, 243; 33/760, 768, 770, 786

(56) References Cited

U.S. PATENT DOCUMENTS

| | | | | |
|---|---|---|---|---|
| 264,593 | * | 9/1882 | Wright | 401/195 |
| 1,577,272 | * | 3/1926 | Treadaway | 401/131 |
| 2,285,000 | * | 6/1942 | Wallace | 401/131 |
| 2,793,617 | * | 5/1957 | Palmer | 401/195 |
| 4,518,273 | * | 5/1985 | Larizza | 401/98 |
| 5,680,709 | * | 10/1997 | Stone | 33/613 |
| 5,815,873 | * | 10/1998 | Jones | 15/106 |
| 5,947,623 | * | 9/1999 | Smith | 401/131 |

FOREIGN PATENT DOCUMENTS

| | | | | |
|---|---|---|---|---|
| 274900 | * | 6/1914 | (DE) | 401/195 |
| 197801 | * | 6/1976 | (FR) | 401/131 |
| 1402068 | * | 5/1965 | (FR) | 401/195 |

* cited by examiner

*Primary Examiner*—Gregory L. Huson
*Assistant Examiner*—Huyen Le
(74) *Attorney, Agent, or Firm*—Robert M. Wolters

(57) ABSTRACT

A plurality of pens or other marking implements is provided. They are set forth as a minimum of two, but by the simple technique of altering the reservoirs, the colors can be substituted almost infinitely. There are two for each implement, and these can be multiplied in two by changing the ink devices. Other changes can be made by duplicating the implements or writing pens, which come in pluralities of two. Adjacent pairs are locked together by shaping of the base, and the pens can be duplicated in initial savings by the colors chosen, and the number of pens can be duplicated depending upon the shape of the devices which are made to be interlinked by joining of the bases, and by the self-return of the base station from which the pens originate, the pens being joined to the base station by flexible links of indeterminate length.

10 Claims, 1 Drawing Sheet

RETRACTABLE UNLOSEABLE MULTICOLORED PEN ASSEMBLY

BACKGROUND OF THE INVENTION

Figure 2:
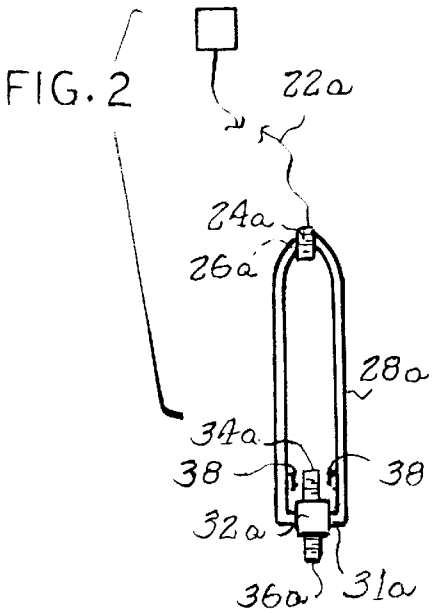

There are many types of multiple pointed pens to deliver different colors. One such pen has either three or four cartridges in order to selectively write with any of the cartridges. Unfortunately, such pens are bulky, and are not subject to a comfortable grip. Furthermore, one color of the group of cartridges always seems to be stuck and will not write. One profession that uses such pens is the nursing profession.

Anyone who has been in a bank has seen a pen which is joined to a base with a flexible, generally unbreakable connector. Such pens are commonly only in one color, and I have seen the tethers broken and the pens missing. Generally, the tethers are made of only bendable materials so that they may be moved to any position. They are not susceptible to easily writing in any position.

I have not seen any pens with a plurality of cartridges that can be moved selectively into position, and which the pens are anchored to the person using them. They never seem to be where they are wanted.

I propose a multi-colored pen, which is clipped to the person using it. A nurse, for instance, may pin the anchor for the pen to a part of her clothing, such as the neckline of a dress. In one form of my invention, there is a mechanical connection for locking successive anchors together so that there can be four or six or any number of writing colors available. As a result, a nurse, for example, may carry a large number of colors for writing, all of which are linked to a position near her person.

OBJECTS AND ADVANTAGES OF THE PRESENT INVENTION

It is a general object of the present invention to provide a pen capable of writing in a plurality of colors, which can be duplicated, which is connected by a flexible tether to the user. The tether is preferably retractable, so that it does not get in the way, yet it is available for use at a plurality of stations.

It is further an object of the present invention to provide a yolk-shaped pen holder which holds a pen which quickly and readily can be pivoted to either of two writing positions, and is secured to a base locked to the wearer's clothing by means of an integral pin.

In achieving the foregoing and other objects of the invention, the pen consists of two pens having different colors or different types of writing ink. The pen or pens are secured to a pivotable central joint in a yolk which is attached by a flexible tether to a fixed position on the wearer's clothing. The fixed position is provided with dovetails at opposite ends, and further dovetails can be latched to one another so that the wearer has as many different color inks as he wants. The base or anchor piece is each provided with a safety pin or the like for securement to the clothing, and therefore, cannot be lost or stolen away. Furthermore, the forty inch nylon cord which serves as a flexible connector is attached to a reel assembly in the locking base so that it can be extended from almost nothing to forty inches for handy writing. Furthermore, the base can be of steel so that a name of the person wearing the pen may be attached for his identification.

THE DRAWINGS

The drawings, when taken in connection with the following specification, will make the invention clearer. The drawing consists of FIG. 1 which comprises a layout of my invention, FIG. 2 is a detailed showing of the pen holder of the present invention.

Figure 3:
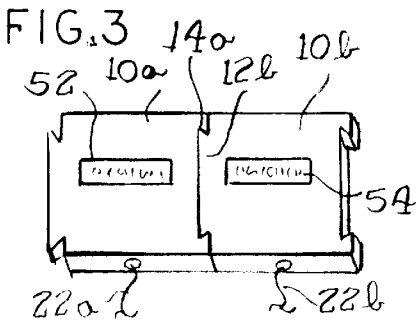

FIG. 3 is a view of a plurality of the pen holders as stacked together to form a multiple holder.

DETAIL VIEW ACCOMPANYING THE DESCRIPTION OF THE PREFERRED SPECIES

Figure 1:
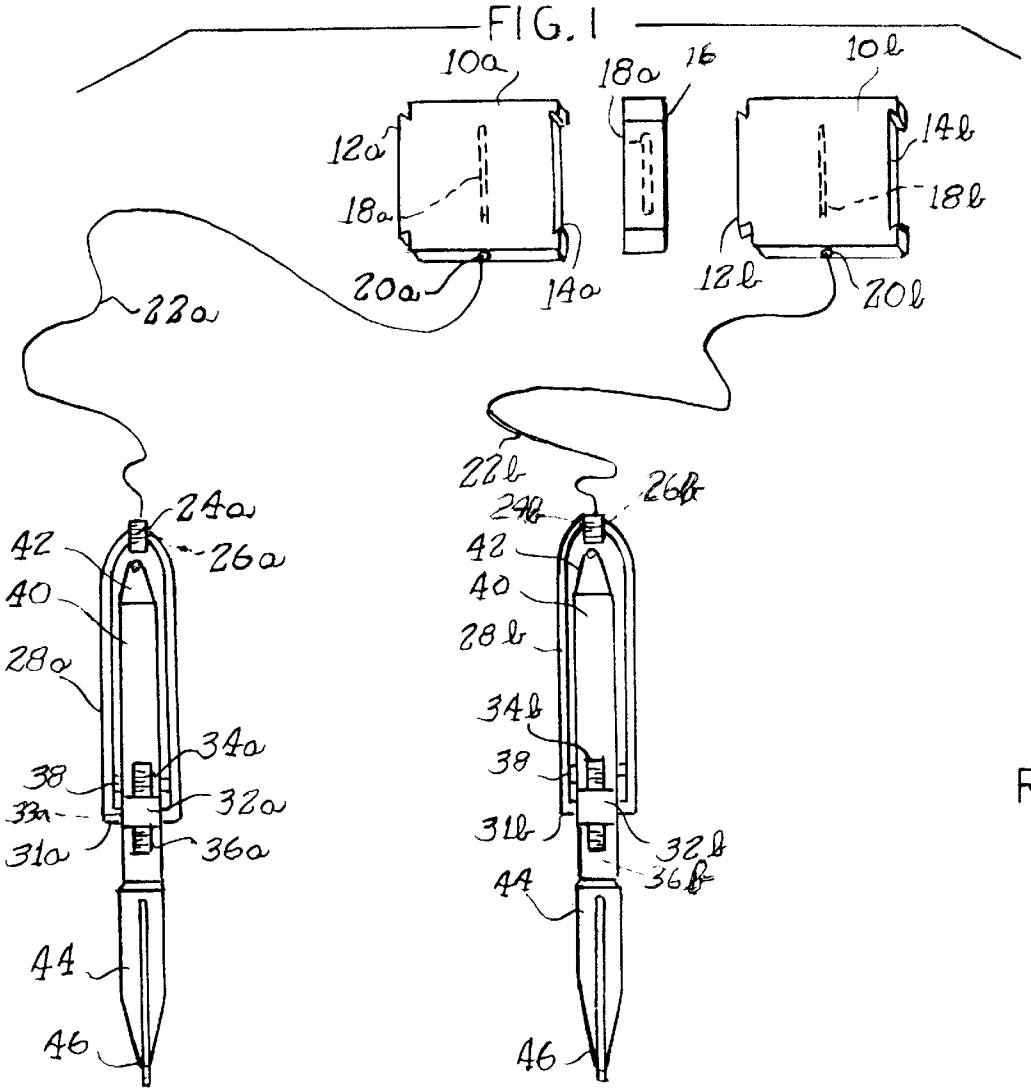

The figure in the center of the drawings comprises FIG. 1, which is the principle drawing. It shows two identical anchors or bases 10*a* and 10*b*. The left side of 10*a* is provided with a male dovetail connector 12*a*, and a similar dovetail, 12*a* is provided on the left of the base 10*b*. The female locking sets or fasteners, 14*a* and 14*b*, are provided on the right hand of the bases 10*a* and 10*b*. Intermediately the bases 10*a* and 10*b*, and rotated 90 degrees to show the parts, are a locking member 12*a* and 12*b* having locking sets 14*a* and 14*b* the right end thereof. It will now be apparent that the locking members 10*a* and 10*b* are of the same height. On the back of each of the bases 10*a* and 10*b*, there are pins 18*a* and 18*b* adapted to penetrate the clothing. The purpose of all of this is to be sure that the bases 10*a* and 10*b*, and the intermediate member 16 may be locked on the clothing of the user.

Each of the bases 10*a* and 10*b*, has on the bottom edge a central aperture 20*a* and 20*b*. The bases are hollow, and house a spring device that rolls up the nylon cord 22*a* and 22*b* inside of the base, so that the nylon cord 22*a* and 22*b* extending therefrom are each automatically retracted so that the pens (noted hereinafter) may be snugged up closely to the bases.

The opposite ends of the two nylon cords, which are, for example, 40 inches in length, may automatically control the snugging of the respective cord. The opposite end of the cord is secured in a hollow threaded member which is received in a threaded hole 26. As an alternative, the member 24*a* is not threaded but simply is soldered into the hole 26, the entire structure being covered with plated gold.

The threaded hole 26*a* need not necessarily be threaded, and is placed at the apex of a twin or dual armed assembly, having lower ends 31*a*. The ends 31*a* terminate at inwardly directed holes 33*a* in which the inwardly directed ends 33*a* are directed at right angles, and fit within the hole 33*a* so that the block 32*a* is free to swivel between the arms 31*a*. The arms 31*a* are aligned, and hence the block 34*a* is free to swivel between them.

A normally directed exteriorly threaded post 34*a* extends up from the swivelling block 32*a*, and a normally threaded post extends downwardly from the swivelling block 34*a* and 36*a*. The remainder of the two-arm post 32*a* is completed by a pair of inwardly directed tabs 38. The purpose of these is not yet shown, but it is to engage a pen to keep it extending downwardly from the block.

A pen 40 extends upwardly from the threaded block 34*a* 36*a* on which it is mounted. The pen is loaded or filled with a yellow pigment, and at the upper end there is a hinged lid 42. A downwardly extending pen 44 holds lead which is capable of being extended at 46 from the tip of the previously identified pen 44. The pen 44 has a twist grip and may be turned in either direction to advance or retract the lead to or from writing position.

The purpose of the protrusions 38 extending inwardly toward one another will now be apparent. The protrusions extend far enough that they will not permit the pen 40 or the pen 44 from passing beyond them. Thus, the pen 40 may extend straight up or straight down, and so may the pen 44. The choice is the user's.

The pen also is automatically stopped at a 180 degree correction extending from the segmented grip or the pens may be flipped so that the member 40 extends down from the segmented grip. Either position is stopped automatically with the appropriate pen extending from the ends or pivot arms 31*a* of the mounting structure 28*a*. A slight digression is made in behalf of the grip 28*a*. A red ink ball point pen 48 is contained between the two halves of the grip 28*b*, and a black ink ball point pen is restrained at 50 pointing in the other direction. Like the pens 42 and 46, the pens 48 and 50 are mounted so as to flip between the two restricted positions provided by the protuberances 38 engaging the body of the pens.

A modification of the bases 10*a* and 10*b* is shown in FIG. 3. The fasteners 12*b* and 14*b* are shown in the assembled position in FIG. 3, and the bases are made of steel, whereas in the first case in FIG. 2, they were made of coated brass. This way a magnetic name tag 52 can be secured to the base la, and a magnetic tag having the person's position may be displayed on a tag 54 attached magnetically to the base 10*b*. In either case, the fasteners have a slight angle to the fitting faces of the bases so that they will wedge together precisely in alignment with one another. Also, in the case of steel elements in the present invention, the bases 10*a* and 10*b* may be reversibly magnetized so that they cling together even better than by means of a precise fit.

A complete description of my invention has now been made. Certain things will be obvious to anyone reading the description, such as the fact that one or two are not minimum but there can be any number of pen links gathered together. There is no limit to the number, except that imposed by weigh and area. Likewise, the colors and number of colors are arbitrary as set forth hereinafter. Any number of colors can be had by simply changing the cartridges or manifolds. The limitation to colors is illustrative only as will be apparent, and a free implementation of writing implements is considered to be an obvious substitution. The block 32*a*, etc., may be square for cosmetic reasons as well as round. The "pen" is shown generically and need not be a conventional writing implement. It can be, f.i., a laser writer. Other changes and substitutions will be made by those skilled in the art, and they will be left to those skilled in the art, and they are left to those who have the device in production.

The number of changes is up to those skilled in the art who may develop new uses as time goes by. The invention is applicable to all of those devices similar to those suggested herein, and a number of those which may develop therefrom are limited only to the imagination of those who operate under the patent.

What is claimed is:

1. A plurality of unloseable pens, each having a base and each base being linked together a quick release mechanical connection, means for connecting each of the bases of the pens to clothing of a person, and extensible and retractable flexible elongated means connecting each pen to its respective base providing a modular expendable pen and base assembly.

2. A plurality of unloseable pens as set forth in claim 1 wherein the bases include steps interfitting with one another forming the quick release mechanical connection between the bases means interfitting with one another.

3. A plurality of unloseable pens as set forth in claim 2 wherein the bases include complementary shapes interengageable with one another as quick release fasteners.

4. A plurality of unloseable pens linked together as set forth in claim 1 seriatim wherein each base includes extending means and complementary recess means which fit together.

5. A plurality of unloseable pens linked together as set forth in claim 1 wherein each elongated means comprises a cord.

6. A plurality of unloseable pens as set forth in claim 1 wherein certain of said bases are made of magnetic material and attract name plates made of magnetic material and susceptible thereto.

7. A plurality of unloseable pens linked together as set forth in claim 1 and each pen further includes a pair of arms, and each pen mounted between each pair of arms and pivotable relative thereto.

8. A plurality of unloseable pens linked together as set forth in claim 7 and further including a protrusion extending from each of the pair of arms and the protrusions in form of a pin are engageable with one of the pens to limit a pivotal angle of the pen with regard to the arms.

9. A plurality of unloseable pens linked together as set forth in claim 1 wherein there are two means extending from a pair of arms toward one another and spaced so as to provide clearance for a pen rotating in one direction relative to said arms, and serving as a stop for a pen rotating in the opposite direction.

10. A plurality of unloseable pens, each having a base and each base linked together through a quick release mechanical connection, means for connecting each of the bases of the pens to clothing of a person, flexible elongated means in the form of a cord connecting each pen to its respective base, a pair of arms connected to each of said flexible elongated means, each pen pivotally connected between each pair of arms, and a pair of projections from said arms projecting toward one another, having insufficient clearance for permitting passage of a pen when said pen is pivoted between said pair of arms in one direction and having insufficient clearance for said pen to engage with said projections as stops when said pen is pivoted in the other direction.

* * * * *